US008986585B2

(12) United States Patent
Cantrell et al.

(10) Patent No.: US 8,986,585 B2
(45) Date of Patent: Mar. 24, 2015

(54) METHOD OF MANUFACTURING CHEMICAL MECHANICAL POLISHING LAYERS HAVING A WINDOW

(75) Inventors: Brian T. Cantrell, Port Deposit, MD (US); Kathleen McHugh, Newark, DE (US); James T. Murnane, Norristown, PA (US); George H. McClain, Middletown, DE (US); Durron A. Hutt, Wilmington, DE (US); Robert A. Brady, Coatesville, PA (US); Christopher A. Young, Newark, DE (US); Jeffrey Borcherdt Miller, West Chester, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 634 days.

(21) Appl. No.: 13/427,408

(22) Filed: Mar. 22, 2012

(65) Prior Publication Data

US 2013/0247477 A1 Sep. 26, 2013

(51) Int. Cl.

| | |
|---|---|
| ***B24D 11/00*** | (2006.01) |
| ***B24B 37/20*** | (2012.01) |
| ***B24D 18/00*** | (2006.01) |

(52) U.S. Cl.

CPC ..... *B24D 11/003* (2013.01); *B24B 37/20* (2013.01); *B24D 18/0009* (2013.01)

USPC ..... 264/157

(58) Field of Classification Search

CPC ..... B24D 11/003

USPC ..... 51/298

See application file for complete search history.

(56) References Cited

U.S. PATENT DOCUMENTS

| | | | |
|---|---|---|---|
| 3,677,681 | A | 7/1972 | Zippel et al. |
| 4,144,295 | A | 3/1979 | Dever, Jr. |
| 5,578,362 | A | 11/1996 | Reinhardt et al. |
| 2009/0053976 | A1 | 2/2009 | Roy et al. |
| 2010/0068322 | A1 | 3/2010 | Browne et al. |
| 2010/0207880 | A1 | 8/2010 | Shaver et al. |

OTHER PUBLICATIONS

Copending U.S. Appl. No. 13/210,432, filed Aug. 16, 2011.
Copending U.S. Appl. No. 13/427,383, filed Mar. 22, 2012.

*Primary Examiner* — Galen Hauth
(74) *Attorney, Agent, or Firm* — Thomas S. Deibert

(57) ABSTRACT

A method of manufacturing polishing layers having a window for use in chemical mechanical polishing pads is provided, wherein a plurality of polishing layers having an integral window are derived from a cake, wherein the formation of density defects in the cake and the surface roughness of the polishing layers formed are minimized.

10 Claims, 13 Drawing Sheets

METHOD OF MANUFACTURING CHEMICAL MECHANICAL POLISHING LAYERS HAVING A WINDOW

The present invention relates generally to the field of manufacture of polishing layers. In particular, the present invention is directed to a method of manufacturing polishing layers for use in chemical mechanical polishing pads.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modem processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes nonplanar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer is mounted on a carrier assembly and positioned in contact with a polishing pad in a CMP apparatus. The carrier assembly provides a controllable pressure to the wafer, pressing it against the polishing pad. The pad is moved (e.g., rotated) relative to the wafer by an external driving force. Simultaneously therewith, a chemical composition ("slurry") or other polishing solution is provided between the wafer and the polishing pad. Thus, the wafer surface is polished and made planar by the chemical and mechanical action of the pad surface and slurry.

Reinhardt et al., U.S. Pat. No. 5,578,362, discloses an exemplary polishing pad known in the art. The polishing pad of Reinhardt comprises a polymeric matrix having microspheres dispersed throughout. Generally, the microspheres are blended and mixed with a liquid polymeric material and transferred to a mold for curing. Conventional wisdom in the art is to minimize perturbations imparted to the contents of the mold cavity during the transferring process. To accomplish this result, the location of the nozzle opening through which the curable material is added to the mold cavity is conventionally maintained centrally relative to the cross section of the mold cavity and as stationary as possible relative to the top surface of the curable material as it collects in the mold cavity. Accordingly, the location of the nozzle opening conventionally moves only in one dimension to maintain a set elevation above the top surface of the curable material in the mold cavity throughout the transferring process. The molded article is then sliced to form polishing layers using a skiver blade, periodically dressed with an abrasive stone. Unfortunately, polishing layers formed in this manner may exhibit unwanted defects (e.g., density defects and uneven, scored surfaces).

Density defects are manifested as variations in the bulk density of the polishing layer material. In other words, areas having a lower filler concentration (e.g., microspheres in the Reinhardt polishing layers). Density defects are undesirable because it is believed that they may cause unpredictable, and perhaps detrimental, polishing performance variations from one polishing layer to the next and within a single polishing layer over its useful lifetime.

The manufacture of polishing layers that exhibit ultra flat polishing surfaces is becoming increasingly desirable.

Accordingly, there is a need for improved methods of manufacturing polishing layers with integral windows for use in chemical mechanical polishing pads, wherein the formation of undesirable density defects are further minimized or eliminated and wherein the surface roughness of the polishing surface of the polishing layer is minimized.

The present invention provides a method of forming a polishing layer for a chemical mechanical polishing pad, comprising: providing a mold, having a mold base and a surrounding wall attached to the mold base; providing a liner with a top surface, a bottom surface and an average thickness of 2 to 10 cm; providing a liner adhesive; providing a window block; providing a window adhesive; providing a curable material comprising a liquid prepolymer; providing a nozzle, having a nozzle opening; providing a skiver blade with a cutting edge; providing a strop; providing a stropping compound; bonding the bottom surface of the liner to the mold base using the liner adhesive, wherein the top surface of the liner and the surrounding wall define a mold cavity; bonding the window block to the top surface of the liner using the window adhesive; charging the curable material through the nozzle opening to the mold cavity during a charging period, CP; allowing the curable material in the mold cavity to cure into a cake; separating the surrounding wall from the mold base and the cake; applying the stropping compound to the cutting edge; stropping the skiver blade with the strop; and, slicing the cake into multiple chemical mechanical polishing layers, wherein each polishing layer has an integral window.

The present invention provides a method of forming a polishing layer for a chemical mechanical polishing pad, comprising: providing a mold, having a mold base and a surrounding wall attached to the mold base; providing a liner with a top surface, a bottom surface and an average thickness of 2 to 10 cm; providing a liner adhesive; providing a window block; providing a window adhesive; providing a curable material comprising a liquid prepolymer; providing a nozzle, having a nozzle opening; providing a skiver blade with a cutting edge; providing a strop; providing a stropping compound; providing a heat source; bonding the bottom surface of the liner to the mold base using the liner adhesive, wherein the top surface of the liner and the surrounding wall define a mold cavity; bonding the window block to the top surface of the liner using the window adhesive; charging the curable material through the nozzle opening to the mold cavity during a charging period, CP; allowing the curable material in the mold cavity to cure into a cake; separating the surrounding wall from the mold base and the cake; applying the stropping compound to the cutting edge; stropping the skiver blade with the strop; exposing the cake to the heating source to form a heated cake; and, slicing the heated cake into multiple chemical mechanical polishing layers, wherein each polishing layer has an integral window.

The present invention provides a method of forming a polishing layer for a chemical mechanical polishing pad, comprising: providing a mold, having a mold base and a surrounding wall attached to the mold base; providing a liner with a top surface, a bottom surface and an average thickness of 2 to 10 cm; providing a liner adhesive; providing a window block; providing a window adhesive; providing a curable material comprising a liquid prepolymer; providing a nozzle, having a nozzle opening; providing a skiver blade with a cutting edge; providing a strop; providing a stropping compound; bonding the bottom surface of the liner to the mold base using the liner adhesive, wherein the top surface of the liner and the surrounding wall define a mold cavity; bonding the window block to the top surface of the liner using the window adhesive; charging the curable material through the nozzle opening to the mold cavity during a charging period, CP; allowing the curable material in the mold cavity to cure into a cake; separating the surrounding wall from the mold base and the cake; applying the stropping compound to the cutting edge; stropping the skiver blade with the strop; and, slicing the cake into multiple chemical mechanical polishing layers, wherein each polishing layer has an integral window; wherein the curable material further comprises a plurality of microelements; wherein the mold base is oriented along an x-y plane, wherein the mold cavity has a central axis, $C_{axis}$, that is perpendicular to the x-y plane, and wherein the mold cavity has a doughnut hole region and a doughnut region; wherein the charging period, CP, is broken down into three separate phases identified as an initial phase, a transition phase and a remainder phase; wherein the nozzle opening has a location and wherein the location of the nozzle opening moves relative to mold base along the mold cavity's central axis, $C_{axis}$, during the charging period, CP, to maintain the location of the nozzle opening above a top surface of the curable material in the mold cavity as the curable material collects in the mold cavity; wherein the location of the nozzle opening resides within the doughnut hole region throughout the initial phase; wherein the location of the nozzle opening transitions from residing within the doughnut hole region to residing within the doughnut region during the transition phase; and, wherein the location of the nozzle opening resides within the doughnut region during the remainder phase.

The present invention provides a method of forming a polishing layer for a chemical mechanical polishing pad, comprising: providing a mold, having a mold base and a surrounding wall attached to the mold base; providing a liner with a top surface, a bottom surface and an average thickness of 2 to 10 cm; providing a liner adhesive; providing a window block; providing a window adhesive; providing a curable material comprising a liquid prepolymer; providing a nozzle, having a nozzle opening; providing a skiver blade with a cutting edge; providing a strop; providing a stropping compound; bonding the bottom surface of the liner to the mold base using the liner adhesive, wherein the top surface of the liner and the surrounding wall define a mold cavity; bonding the window block to the top surface of the liner using the window adhesive; charging the curable material through the nozzle opening to the mold cavity during a charging period, CP; allowing the curable material in the mold cavity to cure into a cake; separating the surrounding wall from the mold base and the cake; applying the stropping compound to the cutting edge; stropping the skiver blade with the strop; exposing the cake to the heating source to form a heated cake; and, slicing the heated cake into multiple chemical mechanical polishing layers, wherein each polishing layer has an integral window; wherein the curable material further comprises a plurality of microelements; wherein the mold base is oriented along an x-y plane, wherein the mold cavity has a central axis, $C_{axis}$, that is perpendicular to the x-y plane, wherein the mold cavity has a doughnut hole region and a doughnut region, and wherein the mold cavity is symmetric about the mold cavity's central axis, $C_{axis}$; wherein the charging period, CP, is broken down into three separate phases identified as an initial phase, a transition phase and a remainder phase; wherein the nozzle opening has a location and wherein the location of the nozzle opening moves relative to mold base along the mold cavity's central axis, $C_{axis}$, during the charging period, CP, to maintain the location of the nozzle opening above a top surface of the curable material in the mold cavity as the curable material collects in the mold cavity; wherein the location of the nozzle opening resides within the doughnut hole region throughout the initial phase; wherein the location of the nozzle opening transitions from residing within the doughnut hole region to residing within the doughnut region during the transition phase; wherein the location of the nozzle opening resides within the doughnut region during the remainder phase; wherein the mold cavity approximates a right cylindrically shaped region having a substantially circular cross section, $C_{x\text{-}sect}$; wherein the mold cavity has an axis of symmetry, $C_{x\text{-}sym}$, which coincides with the mold cavity's central axis, $C_{axis}$; wherein the right cylindrically shaped region has a cross sectional area, $C_{x\text{-}area}$, defined as follows:

$$C_{x\text{-}area=\pi rC}^{2},$$

wherein $r_C$ is the average radius of the mold cavity's cross sectional area, $C_{x\text{-}area}$, projected onto the x-y plane; wherein the doughnut hole region is a right cylindrically shaped region within the mold cavity that projects a circular cross section, $DH_{x\text{-}sect}$, onto the x-y plane and has an axis of symmetry, $DH_{axis}$; wherein the doughnut hole has a cross sectional area, $DH_{x\text{-}area}$, defined as follows:

$$DH_{x\text{-}area=\pi rDH}^{2},$$

wherein $r_{DH}$ is a radius of the doughnut hole region's circular cross section, $DH_{x\text{-}sect}$; wherein the doughnut region is a toroid shaped region within the mold cavity that projects an annular cross section, $D_{x\text{-}sect}$, onto the x-y plane and that has a doughnut region axis of symmetry, $D_{axis}$; wherein the annular cross section, $D_{x\text{-}sect}$, has a cross sectional area, $D_{x\text{-}area}$, defined as follows:

$$D_{x\text{-}area}=\pi R_D^2-\pi r_D^2$$

wherein $R_D$ is a larger radius of the doughnut region's annular cross section, $D_{x\text{-}sect}$; wherein $r_D$ is a smaller radius of the doughnut region's annular cross section, $D_{x\text{-}sect}$; wherein $r_D \geq r_{DH}$; wherein $R_D > r_D$; wherein $R_D < r_C$.; wherein each of the $C_{x\text{-}sym}$, the $DH_{axis}$ and the $D_{axis}$ are perpendicular to the x-y plane.

DETAILED DESCRIPTION

Figure 1:
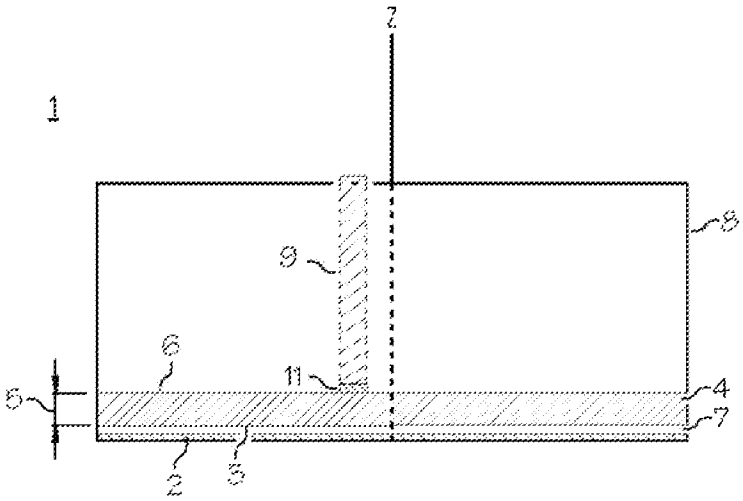
FIG. 1 is a depiction of a side elevation view of a mold.

Surprisingly, it has been found that in the manufacture of polishing layers having integral windows for use in chemical mechanical polishing pads, movement of the location of the nozzle opening through which a curable material is charged into a mold cavity in three dimensions both along and about a central axis, $C_{axis}$, of the mold cavity while charging the curable material into the mold cavity significantly reduces the occurrence of density defects in the polishing layers produced relative to those produced by an identical process, wherein the location of the nozzle opening moves in only one dimension along the mold cavity's central axis, $C_{axis}$.

It has also been found that polishing layers having integral windows produced using the method of the present invention exhibit a polishing surface with a decreased surface roughness compared to polishing layers produced using the same process except that throughout the charging period, CP, the location of the nozzle opening moves in only one dimension along the mold cavity's central axis, $C_{axis}$ (i.e., to maintain the location of the nozzle opening at a set elevation above the top surface of the curable material as it collects in the mold cavity) and the skiver blade is stone sharpened rather than stropped before cake skiving. It has been discovered that the cutting edge of the skiver blade becomes almost imperceptibly distorted and wavy after skiving a cake into a plurality of chemical mechanical polishing layers. It is believed that the prior art approach to sharpening the cutting edge with a stone results in the removal of material from the wavy portions of the cutting edge to provide a flat honed surface, but at the cost of varying tensile properties of the cutting edge across the length of the skiver blade; resulting in a non-uniformity in its cutting properties and an increased surface roughness in the polishing layers produced therewith. It has been surprisingly found that stropping of the cutting edge facilitates both the flattening and the honing of the wavy portions of the cutting edge, while maintaining a more consistent cutting edge across the length of the skiver blade; resulting in a significant reduction in the surface roughness of the chemical mechanical polishing layers produced therewith. It is believed that a decreased surface roughness of the polishing surface facilitates improved polishing defectivity performance during subsequent use of the chemical mechanical polishing pad containing the polishing layer.

The term "surface roughness" as used herein and in the appended claims refers to the roughness of the polishing surface of a polishing layer as determined using a profilometer, for example, a Zeiss Surfcom profilometer using the following parameter settings: measurement type—Gaussian; tilt—straight; tilt correction—least square; measurement length—0.6 inch (15.24 mm); cutoff wavelength—0.1 inch (2.54 mm); measurement speed—0.24 inch/s (6.1 mm/s); and, cutoff filter ratio—300.

The term "charging period or CP" as used herein and in the appended claims refers to the period of time (in seconds) over which curable material is charged into the mold cavity starting at the moment when the first of the curable material is introduced into the mold cavity until the moment when the last of the curable material is introduced into the mold cavity.

The term "charging rate or CR" as used herein and in the appended claims refers to the mass flow rate (in kg/sec) at which the curable material is charged to the mold cavity during the charging period, CP, (in seconds).

The term "initial phase starting point or $SP_{IP}$" as used herein and in the appended claims refers to the location of the nozzle opening at the start of the initial phase of the charging period, which coincides with the start of the charging period.

The term "initial phase ending point or $EP_{IP}$" as used herein and in the appended claims refers to the location of the nozzle opening at the end of the initial phase of the charging period, which immediately precedes the start of the transition phase of the charging period.

The term "initial phase path" as used herein and in the appended claims refers to the path of movement (if any) of the location of the nozzle opening during the initial phase of the charge period from the initial phase starting point, $SP_{TP}$, to the initial phase ending point, $EP_{IP}$.

The term "transition phase starting point or $SP_{TP}$" as used herein and in the appended claims refers to the location of the nozzle opening at the start of the transition phase of the charging period. The transition phase starting point, $SP_{TP}$, and the initial phase ending point, $EP_{TP}$, are at the same location.

The term "transition phase transition point(s) or $TP_{TP}$" as used herein and in the appended claims refers to the location(s) of the nozzle opening during the transition phase of the charging period at which the direction of movement of the location of the nozzle opening relative to the mold cavity's central axis, $C_{axis}$, changes (i.e., the direction of movement in the x and y dimensions).

The term "transition phase ending point or $EP_{TP}$" as used herein and in the appended claims refers to the first location of the nozzle opening within the doughnut region of a mold cavity at which the direction of movement of the location of the nozzle opening relative to the mold cavity's central axis, $C_{axis}$, changes. The transition phase ending point, $EP_{TP}$, is also the location of the nozzle opening at the end of the transition phase of the charging period, which immediately precedes the remainder phase of the charging period.

The term "transition phase path" as used herein and in the appended claims refers to the path taken by the location of the nozzle opening during the transition phase of the charging period from the transition phase starting point, $SP_{TP}$, to the transition phase ending point, $EP_{TP}$.

The term "remainder phase starting point or $SP_{RP}$" as used herein and in the appended claims refers to the location of the nozzle opening at the start of the remainder phase of the charging period. The remainder phase starting point, $SP_{RP}$, and the transition phase ending point, $EP_{TP}$, are at the same location.

The term "remainder phase transition points or $TP_{RP}$" as used herein and in the appended claims refer to the locations of the nozzle opening during the remainder phase of the charging period at which the direction of movement of the location of the nozzle opening relative to the mold cavity's central axis, $C_{axis}$, changes.

The term "remainder phase ending point or $EP_{RP}$" as used herein and in the appended claims refers to the location of the nozzle opening at the end of the remainder phase of the charging period, which coincides with the end of the charging period.

The term "remainder phase path" as used herein and in the appended claims refers to the path taken by the location of the nozzle opening during the remainder phase of the charging period from the remainder phase starting point, $SP_{RP}$, to the remainder phase ending point, $EP_{RP}$.

The term "poly(urethane)" as used herein and in the appended claims encompasses (a) polyurethanes formed from the reaction of (i) isocyanates and (ii) polyols (including diols); and, (b) poly(urethane) formed from the reaction of (i) isocyanates with (ii) polyols (including diols) and (iii) water, amines or a combination of water and amines.

The term "substantially non-porous" as used herein and in the appended claims in reference to the liner, means that the liner contains ≤5% porosity by volume.

The term "essentially constant" as used herein and in the appended claims in reference to the charging rate of curable material during the charging period means that the following expressions are both satisfied:

$$CR_{max} \leq (1.1 * CR_{avg})$$

$$CR_{min} \geq (0.9 * CR_{avg})$$

wherein $CR_{max}$ is the maximum mass flow rate (in kg/sec) at which the curable material is charged to the mold cavity during the charging period; wherein $CR_{min}$ is the minimum mass flow rate (in kg/sec) at which the curable material is charged to the mold cavity during the charging period; and wherein $CR_{avg}$ the total mass (in kg) of curable material charged to the mold cavity over the charging period divided by the length of the charging period (in seconds).

The term "gel time" as used herein and in the appended claims in reference to a curable material means the total cure time for that mixture as determined using a standard test method according to ASTM D3795-00a (Reapproved 2006) (*Standard Test Method for Thermal Flow, Cure, and Behavior Properties of Pourable Thermosetting Materials by Torque Rheometer*).

Figure 2:
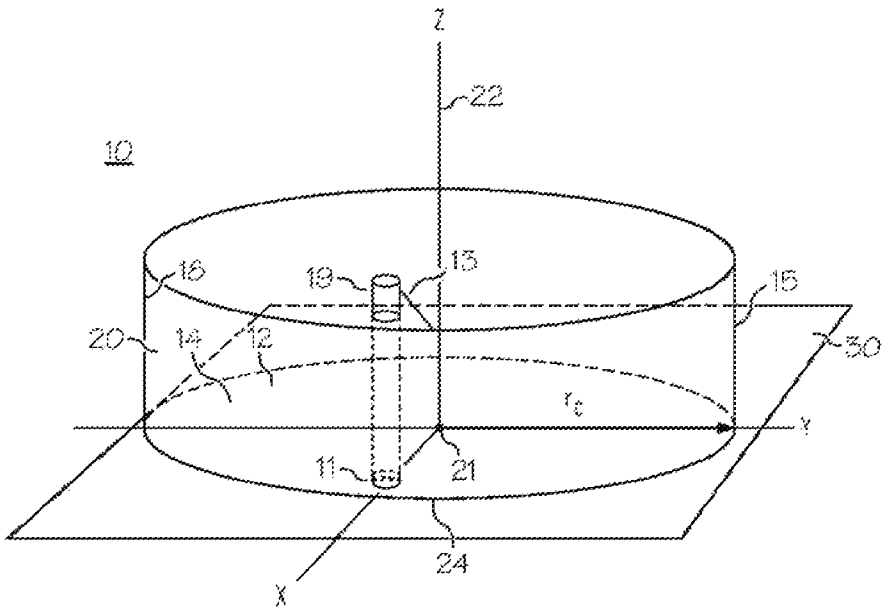
FIG. 2 is a depiction of a perspective top/side view of a mold having a mold cavity with a substantially circular cross section.

The term "substantially circular cross section" as used herein and in the appended claims in reference to a mold cavity (20) means that the longest radius, $r_C$, of the mold cavity (20) projected onto the x-y plane (30) from the mold cavity's central axis, $C_{axis}$, (22) to a vertical internal boundary (18) of a surrounding wall (15) is ≤20% longer than the shortest radius, $r_C$, of the mold cavity (20) projected onto the x-y plane (30) from the mold cavity's central axis, $C_{axis}$, (22) to the vertical internal boundary (18). (See FIG. 2).

Figure 3:
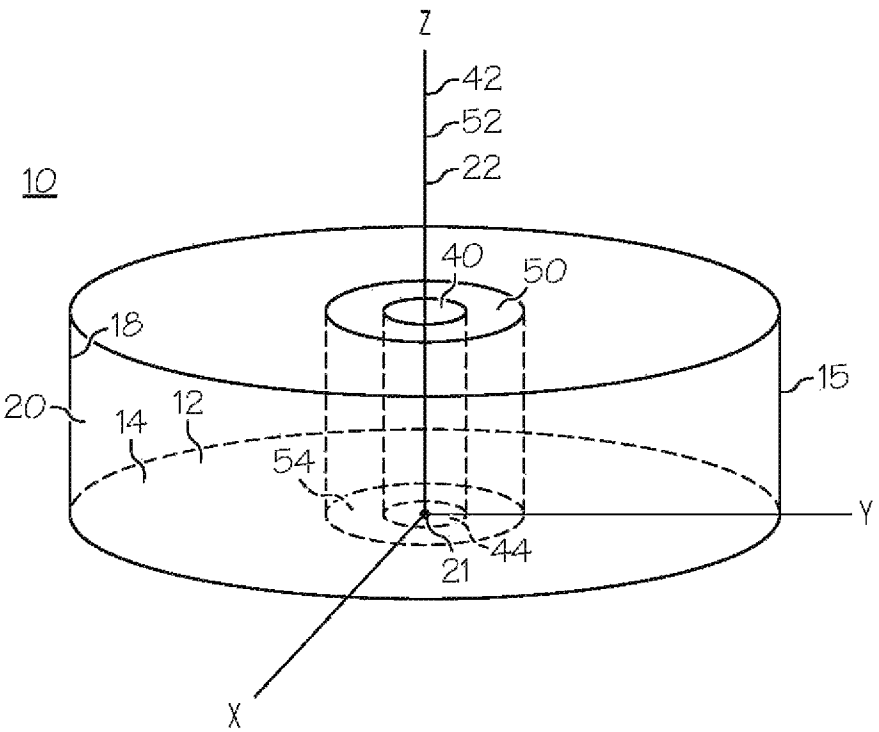
FIG. 3 is a depiction of a perspective top/side view of a mold having a mold cavity with a substantially circular cross section depicting a doughnut hole region and a doughnut region within the mold cavity.

The term "mold cavity" as used herein and in the appended claims refers to the volume defined by a horizontal internal boundary (14) corresponding to a top surface (6, 12) of a liner (4) and a vertical internal boundary (18) of a surrounding wall (15). (See FIGS. 1-3).

The term "substantially perpendicular" as used herein and in the appended claims in reference to a first feature (e.g., a horizontal internal boundary; a vertical internal boundary) relative to a second feature (e.g., an axis, an x-y plane) means that the first feature is at an angle of 80 to 100° to the second feature.

The term "essentially perpendicular" as used herein and in the appended claims in reference to a first feature (e.g., a horizontal internal boundary; a vertical internal boundary) relative to a second feature (e.g., an axis, an x-y plane) means that the first feature is at an angle of 85 to 95° to the second feature.

The term "density defect" as used herein and in the appended claims refers to a region in a polishing layer having a significantly reduced filler concentration relative to the rest of the polishing layer. Density defects are visually detectable with the unaided human eye upon placing the polishing layer on a light table, wherein the density defects appear as regions having a markedly higher transparency compared with the rest of the polishing layer.

Figure 8B:
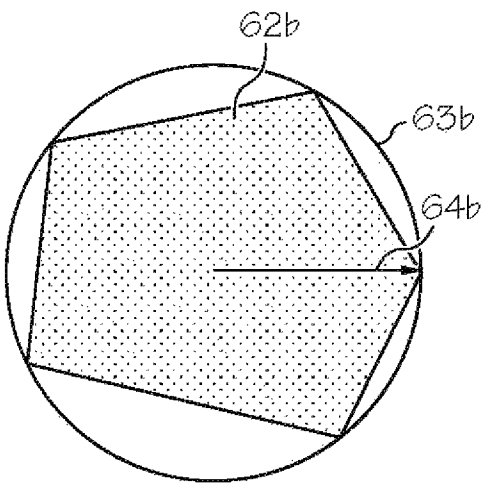
FIG. 8B is a depiction of a plan view of a nozzle opening, wherein the nozzle opening is non-circular.
Figure 8A:
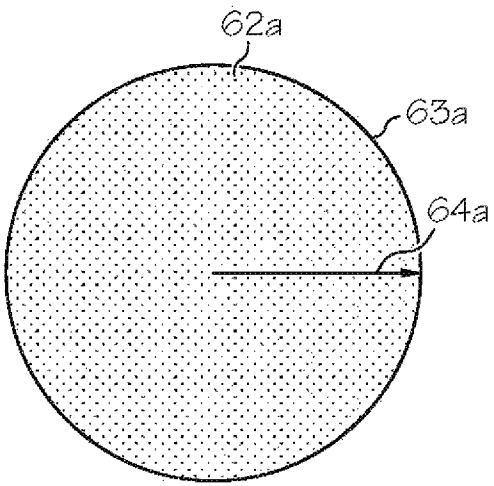
FIG. 8A is a depiction of a plan view of a nozzle opening, wherein the nozzle opening is circular.

The term "nozzle opening radius or $r_{NO}$" used herein and in the appended claims in reference to a nozzle opening means the radius, $r_{SC}$, of the smallest circle, SC, that can completely occlude the nozzle opening. That is, $r_{NO}=r_{SC}$. For illustrative purposes, see FIGS. 8A-8B. FIG. 8A is a depiction of a plan view of a nozzle opening (62*a*) completely occluded by a smallest circle, SC, (63*a*) having a radius, $r_{SC}$, (64*a*); wherein the nozzle opening is circular. FIG. 8B is a depiction of a plan view of a nozzle opening (62*b*) completely occluded by a smallest circle, SC, (63*b*) having a radius, $r_{SC}$, (64*b*); wherein the nozzle opening is non-circular. Preferably, $r_{NO}$ is 5 to 13 mm. More preferably $r_{NO}$ is 8 to 10 mm.

The method of the present invention for forming a polishing layer with an integral window for a chemical mechanical polishing pad uses a mold (1) having a mold base (2) and a surrounding wall (8) attached to the mold base (2); wherein a liner (4) with a top surface (6), a bottom surface (3) and an average thickness (5), $t_L$, is bonded to the mold base (2) using a liner adhesive (7) interposed between the bottom surface (3) of the liner (4) and the mold base (2); and wherein a window block (9,19) is disposed within the mold cavity (20). (See FIGS. 1-2). Preferably, the window block (9,19) is bonded to the top surface (6) of the liner (4) using a window adhesive (11) and aligned within the mold cavity (20) using a stabilizer bracket (13). Preferably, the stabilizer bracket (13) is mounted to the surrounding wall (8). It is believed that the bonding of the window block (9,19) to the liner (4) using a window adhesive (11) alleviates the formation of window distortions (e.g., a window bulging outward from the polishing layer) when skiving a cured cake into a plurality of polishing layers, wherein each polishing layer has an integral window.

The liner (4) used in the method of the present invention facilitates the mating of a curable material as it reacts to form a solidified cake, wherein the curable material bonds to the liner (4) with sufficient strength so that the cured cake does not delaminate from the liner during skiving. Preferably, the liner (4) used in the method of the present invention is periodically removed from the mold base (2) and replaced. The liner (4) used in the method of the present invention can be any material to which the curable material will bond upon curing. Preferably, the liner (4) used is a polyurethane polymeric material. More preferably, the liner (4) used is formed from a prepolymer reaction product of toluene diisocyanate and polytetramethylene ether glycol with an aromatic diamine curative. Most preferably the aromatic diamine curative is selected from 4,4'-methylene-bis-o-chloroaniline and 4,4'-methylene-bis-(3-chloro-2,6-diethylaniline). Preferably, the prepolymer reaction product has a 6.5 to 15.0 weight percent unreacted NCO concentration. Commercially available prepolymers having an unreacted NCO concentration of 6.5 to 15.0 wt % include, for example: Airthane® prepolymers PET-70D, PHP-70D, PET-75D, PHP-75D, PPT-75D, and PHP-80D manufactured by Air Products and Chemicals, Inc.; and, Adiprene® prepolymers, LFG740D, LF700D, LF750D, LF751D, LF753D, and L325 manufactured by Chemtura. Preferably, the curative and the prepolymer reaction product are combined at a stoichiometric ratio of 90 to 125% (more preferably, 97 to 125 percent; most preferably, 100 to 120%) of $NH_2$ (or OH) in the curative to unreacted NCO in the prepolymer. This stoichiometry can be achieved either directly, by providing the stoichiometric levels of the raw materials, or indirectly by reacting some of the NCO with water either purposely or by exposure to adventitious moisture. The liner (4) used can be porous or non-porous. Preferably, the liner (4) used is substantially non-porous.

The liner (4) used in the method of the present invention preferable exhibits an average thickness (5), $t_L$, of 2 to 10 cm (more preferably 2 to 5 cm) measured using a granite base comparator (e.g., a Chicago Dial Indicator Cat#6066-10) at a plurality of randomly selected points (i.e., ≥10 points) across the liner (4). (See FIG. 1).

The liner adhesive (7) used in the method of the present invention can be any adhesive suitable for bonding the liner (4) to the mold base (2). For example, the liner adhesive (7) used can be selected from pressure sensitive adhesives, hot melt adhesives, contact adhesives and combinations thereof. Preferably, the liner adhesive (7) used will both (a) bond the liner (4) to the mold base (2) with sufficient strength to prevent delamination of the liner (4) from the mold base (2) during the cake skiving operation; and, (b) be removable from the mold base (2) without physical damage to the mold base (2) or leaving a deleterious residue (i.e., a residue that impairs the obtainment of a functional bond between the mold base (2) and a replacement liner). Preferably, the liner adhesive (7) is a pressure sensitive adhesive.

The mold base (2) used in the method of the present invention can be any suitably rigid material that will support the weight of the curable material to be charged into the mold cavity; will facilitate the transfer of the filled mold between the equipment used for charging, curing (e.g., large ovens) and skiving the cured cake; and, can withstand the temperature swings associated with the process without warping. Preferably, the mold base (2) used is made of stainless steel (more preferably 316 stainless steel).

Window block materials suitable for use in the method of the present invention for making a polishing layer having an integral window are well known in the art.

The window adhesive (11) used in the method of the present invention can be any adhesive suitable for bonding the window block (9,19) to the top surface (6,12) of the liner (4). Preferably, the window adhesive (11) used will bond the window block (9,19) to the top surface (6,12) of the liner (4) with sufficient strength to prevent delamination of the window block (9,19) from the top surface (6,12) of the liner (4) during the charging of curable material into the mold cavity and during cake skiving operation. The window adhesive (11) used preferably exhibits a low volatile content such that off-gassing is minimized during the charging of curable material into the mold cavity and the curing of that material. Preferably, the window adhesive (11) is a reactive chemically curing adhesive (most preferably, a two part adhesive). Reactive chemically curing two part adhesives include, for example, two component epoxy adhesives (e.g., Adtech® EA-616 Epoxy Weld Adhesive), two component methyl methacrylate adhesives (e.g., Plexus™ MA310 two part methacrylate adhesive), two component silicon adhesives (e.g., Elastosil® P 7670 A/B) and two component urethane adhesives (e.g., Loctite® U09LV).

The top surface (12) of the liner used in the method of the present invention defines a horizontal internal boundary (14) of the mold cavity (20). (See, e.g., FIGS. 2-3). Preferably, the horizontal internal boundary (14) of the mold cavity (20) is flat. More preferably, the horizontal internal boundary (14) of the mold cavity (20) is flat and is substantially perpendicular to the mold cavity's central axis, $C_{axis}$. Most preferably, the horizontal internal boundary (14) of the mold cavity (20) is flat and is essentially perpendicular to the mold cavity's central axis, $C_{axis}$.

The surrounding wall (15) of the mold (10) used in the method of the present invention defines a vertical internal boundary (18) of the mold cavity (20). (See, e.g., FIGS. 2-3). Preferably, the surrounding wall defines a vertical internal boundary (18) of the mold cavity (20) that is substantially perpendicular to the x-y plane (30). More preferably, the surrounding wall defines an vertical internal boundary (18) of the mold cavity (20) that is essentially perpendicular to the x-y plane (30).

Figure 4:
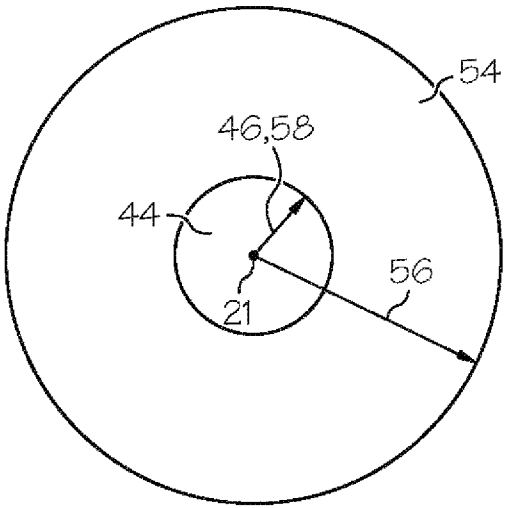
FIG. 4 is a depiction of a top plan view of the doughnut hole and doughnut region depicted in FIG. 3.

The mold cavity (20) has a central axis, $C_{axis}$, (22) that coincides with the z-axis and that intersects the horizontal internal boundary (14) of the mold cavity (20) at a center point (21). Preferably, the center point (21) is located at the geometric center of the cross section, $C_{x\text{-}sect}$, (24) of the mold cavity (20) projected onto the x-y plane (30). (See, e.g., FIGS. 2-4).

The mold cavity's cross section, $C_{x\text{-}sect}$, projected onto the x-y plan can be any regular or irregular two dimensional shape. Preferably, the mold cavity's cross section, $C_{x\text{-}sect}$, is selected from a polygon and an ellipse. More preferably, the mold cavity's cross section, $C_{x\text{-}sect}$ is a substantially circular cross section having an average radius, $r_C$ (preferably, wherein $r_C$ is 20 to 100 cm; more preferably, wherein $r_C$ is 25 to 65 cm; most preferably, wherein $r_C$ is 40 to 60 cm). Most preferably, the mold cavity approximates a right cylindrically shaped region having a substantially circular cross section, $C_{x\text{-}sect}$; wherein the mold cavity has an axis of symmetry, $C_{x\text{-}sym}$, which coincides with the mold cavity's central axis, $C_{axis}$; wherein the right cylindrically shaped region has a cross sectional area, $C_{x\text{-}area}$, defined as follows:

$$C_{x\text{-}area=\pi r C^2},$$

wherein $r_C$ is the average radius of the mold cavity's cross sectional area, $C_{x\text{-}area}$, projected onto the x-y plane; and wherein $r_c$ is 20 to 100 cm (more preferably 25 to 65 cm; most preferably 40 to 60 cm).

The mold cavity (20) has a doughnut hole region (40) and a doughnut region (50). (See, e.g., FIGS. 3-4). The window block (not shown) is disposed within the mold cavity (20) outside of both the doughnut hole region (40) and the doughnut region (50).

Preferably, the doughnut hole region (40) of the mold cavity (20) is a right cylindrically shaped region within the mold cavity (20) that projects a circular cross section, $DH_{x\text{-}sect}$ (44) onto the x-y plane (30) and that has a doughnut hole region axis of symmetry, $DH_{axis}$, (42); wherein the $DH_{axis}$ coincides with the mold cavity's central axis, $C_{axis}$, and the z-axis. (See, e.g., FIGS. 3-4). The circular cross section, $DH_{x\text{-}sect}$, (44) of the doughnut hole region (40) has a cross sectional area, $DH_{x\text{-}area}$, defined as follows:

$$DH_{x\text{-}area=\pi r DH^2},$$

wherein $r_{DH}$ is the radius (46) of the doughnut hole region's circular cross section, $DH_{x\text{-}sect}$, (44). Preferably, wherein $r_{DH} \geq r_{NO}$ (more preferably, wherein $r_{DH}$ is 5 to 25 mm; most preferably, wherein $r_{DH}$ 8 to 15 mm).

Preferably, the doughnut region (50) of the mold cavity (20) is a toroid shaped region within the mold cavity (20) that projects an annular cross section, $D_{x\text{-}sect}$, (54) onto the x-y plane (30) and that has a doughnut region axis of symmetry, $D_{axis}$, (52); wherein the $D_{axis}$ coincides with the mold cavity's central axis, $C_{axis}$, and the z-axis. (See, e.g., FIGS. 3-4). The annular cross section, $D_{x\text{-}sect}$, (54) of the doughnut region (50) has a cross sectional area, $D_{x\text{-}area}$, defined as follows:

$$D_{x\text{-}area}=\pi R_D^2-\pi r_D^2,$$

wherein $R_D$ is the larger radius (56) of the doughnut region's annular cross section, $D_{x\text{-}sect}$; wherein $r_D$ is the smaller radius (58) of the doughnut region's annular cross section, $D_{x\text{-}sect}$; wherein $r_D \geq r_D$; wherein $R_D > r_D$; and wherein $R_D < r_C$. Preferably, wherein $r_D \geq r_{DH}$ and wherein $r_D$ is 5 to 25 mm. More preferably, wherein $r_D \geq r_{DH}$ and wherein $r_D$ is 8 to 15 mm. Preferably, wherein $r_D \geq r_{DH}$; wherein $R_D > r_D$; and wherein $R_D \leq (K^* r_C)$, wherein K is 0.01 to 0.2 (more preferably, wherein K is 0.014 to 0.1; most preferably, wherein K is 0.04 to 0.086). More preferably, wherein $r_D \geq r_{DH}$; wherein $R_D > r_D$; and wherein $R_D$ is 20 to 100 mm (more preferably, wherein $R_D$ is 20 to 80 mm; most preferably, wherein $R_D$ is 25 to 50 mm).

The length of the charging period, CP, in seconds can vary significantly. For example, the length of the charging period, CP, will depend on the size of the mold cavity, the average charging rate, $CR_{avg}$, and the properties of the curable material (e.g., gel time). Preferably, the charging period, CP, is 60 to 900 seconds (more preferably 60 to 600 seconds, most preferably 120 to 360 seconds). Typically, the charging period, CP, will be constrained by the gel time exhibited by the curable material. Preferably, the charging period, CP, will be less than or equal to the gel time exhibited by the curable material being charged to the mold cavity. More preferably, the charging period, CP, will be less than the gel time exhibited by the curable material.

The charging rate, CR, (in kg/sec) can vary over the course of the charging period, CP. For example, the charging rate, CR, can be intermittent. That is, the charging rate, CR, can momentarily drop to zero at one or more times over the course of the charging period. Preferably, the curable material is charged to the mold cavity at an essentially constant rate over the charging period. More preferably, the curable material is charged to the mold cavity at an essentially constant rate over the charging period, CP, with an average charging rate, $CR_{avg}$, of 0.015 to 2 kg/sec (more preferably 0.015 to 1 kg/sec; most preferably 0.08 to 0.4 kg/sec).

The charging period, CP, is broken down into three separate phases identified as an initial phase, a transition phase and a remainder phase. The start of the initial phase corresponds with the start of the charging period, CP. The end of the initial phase immediately precedes the start of the transition phase. The end of the transition phase immediately precedes the start of the remainder phase. The end of the remainder phase corresponds with the end of the charging period, CP.

Figure 5A:
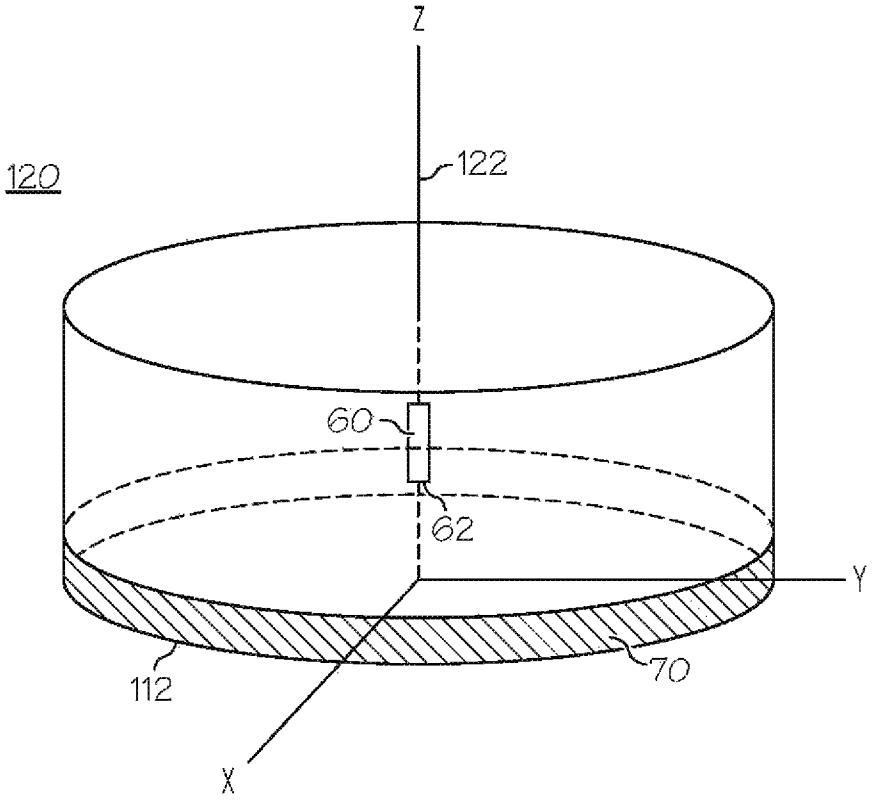
FIG. 5A is a depiction of a perspective top/side view of a mold cavity having a substantially circular cross section with a nozzle disposed within the mold cavity, wherein the mold cavity is partially filled with a curable material.
Figure 5B:
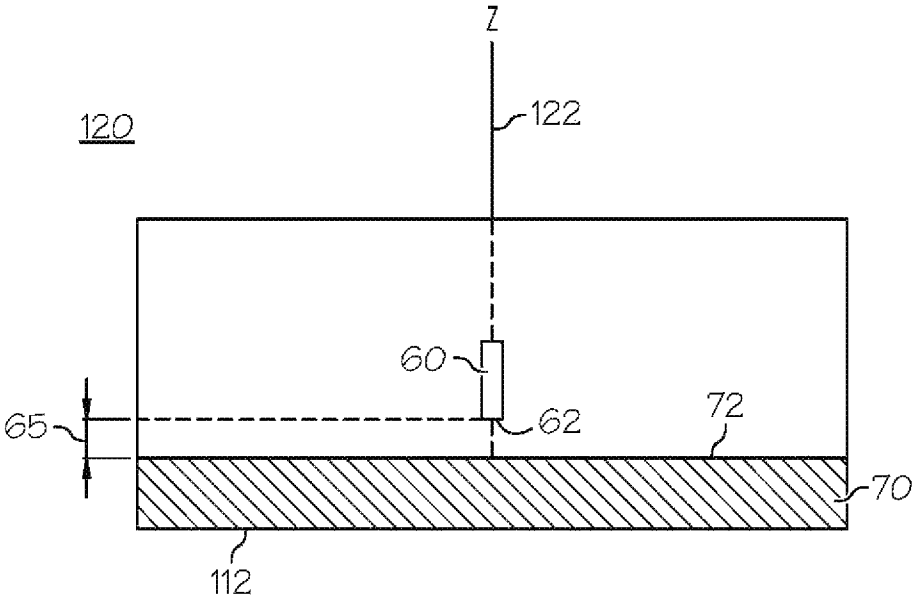
FIG. 5B is a depiction of a side elevation view of the mold cavity depicted in FIG. 5A.

The nozzle moves or transforms (e.g., telescopes) during the charging period, CP, such that the location of the nozzle opening moves in all three dimensions. The nozzle (60) moves or transforms (e.g., telescopes) during the charging period, CP, such that the location of the nozzle opening (62) moves relative to the horizontal internal boundary (112) of the mold cavity (120) along the mold cavity's central axis, $C_{axis}$, (122) during the charging period, CP, to maintain the location of the nozzle opening (62) above the top surface (72) of the curable material (70) as the curable material (70) collects in the mold cavity (120). (See FIGS. 5A-5B). Preferably, the location of the nozzle opening (62) moves relative to the horizontal internal boundary (112) of the mold cavity (120) along the mold cavity's central axis, $C_{axis}$, (122) during the charging period, CP, to maintain the location of the nozzle opening (62) at an elevation (65) above the top surface (72) of the curable material (70) as the curable material (70) collects in the mold cavity (120); wherein the elevation is >0 to 30 mm (more preferably, >0 to 20 mm; most preferably, 5 to 10 mm). (See FIG. 5B). The location of the nozzle opening can momentarily pause in its motion along the mold cavity's central axis, $C_{axis}$, (i.e., its motion in the z dimension) during the charging period. Preferably, the location of the nozzle opening momentarily pauses in its motion relative to the mold cavity's central axis, $C_{axis}$, at each transition phase transition point, $TP_{TP}$, (if any) and at each remainder phase transition point, $TP_{RP}$ (i.e., the location of the nozzle opening momentarily stops moving in the z dimension).

The location of the nozzle opening resides within the doughnut hole region of the mold cavity throughout the initial phase of the charging period (i.e., for the duration of the initial phase). The location of the nozzle opening can remain stationary throughout the initial phase, wherein the initial phase starting point, $SP_{IP}$ and the initial phase ending point, $EP_{IP}$, are the same location (i.e., $SP_{IP}=EP_{IP}$). Preferably, when $SP_{IP}=EP_{IP}$, the initial phase is >0 to 90 seconds long (more preferably >0 to 60 seconds long; most preferably 5 to 30 seconds long). Most preferably, the location of the nozzle opening remains stationary from the start of the initial phase of the charging period until the top surface of curable material in the mold cavity begins to rise at which moment the transition phase begins; wherein the initial phase starting point, $SP_{IP}$, (80) and the initial phase ending point, $EP_{IP}$, (81*a*) (which point coincides with a transition phase starting point, $SP_{TP}$, (82*a*)) are the same location within the doughnut hole region (140) of the mold cavity (220) along the mold cavity's central axis, $C_{axis}$, (222). Preferably, wherein the doughnut hole region (140) is a right circular cylinder; and wherein the doughnut hole's axis of symmetry, $DH_{axis}$, (142) coincides with the mold cavity's central axis, $C_{axis}$, (222) and the z-axis. (See FIGS. 6A-6C). The location of the nozzle opening can move during the initial phase, wherein the initial phase starting point, $SP_{IP}$, is different from the initial phase ending point, $EP_{IP}$ (i.e., $SP_{IP} \neq EP_{IP}$). Preferably, when $SP_{IP} \neq EP_{IP}$; the initial phase is >0 to (CP-10.02) seconds long; wherein CP is the charge period in seconds. More preferably, when $SP_{IP} \neq EP_{IP}$; the initial phase is >0 to (CP-30) seconds long; wherein CP is the charge period in seconds. Most preferably, when the top surface of the curable material in the mold cavity (220) rises during the initial phase of the charging period, the location of the nozzle opening preferably moves within the doughnut hole region (140) of the mold cavity (220) along the mold cavity's central axis, $C_{axis}$, (222) from an initial phase starting point, $SP_{IP}$, (80) to an initial phase ending point, $EP_{IP}$, (81*b*) (which point coincides with a transition phase starting point, $SP_{TP}$, (82*b*)) to maintain the location of the nozzle opening at an elevation above the top surface of the curable material as it collects in the mold cavity (220) throughout the initial phase of the charging period. (See FIGS. 6A-6C).

The location of the nozzle opening moves from a point within the doughnut hole region of the mold cavity to a point within the doughnut region during the transition phase of the charging period. Preferably, the transition phase is 0.02 to 30 seconds long (more preferably, 0.2 to 5 seconds long; most preferably, 0.6 to 2 seconds long). Preferably, the location of the nozzle opening moves relative to the mold cavity's central axis, $C_{axis}$, during the transition phase at an average speed of 10 to 70 mm/sec (more preferably 15 to 35 mm/sec, most preferably 20 to 30 mm/sec). Preferably, wherein the movement of the location of the nozzle opening momentarily pauses in its motion relative to the mold cavity's central axis, $C_{axis}$, (i.e., momentarily stops moving in the x and y dimensions) at each transition phase transition point, $TP_{TP}$, (if any) and at the transition phase ending point, $EP_{TP}$. Preferably, the location of the nozzle opening moves at a constant speed relative to the mold cavity's central axis, $C_{axis}$, during the transition phase from the transition phase starting point, $SP_{TP}$, through any transition phase transition points, $TP_{TP}$, to the transition phase ending point, $EP_{TP}$. Preferably, during the transition phase the location of the nozzle opening moves from the transition phase starting point, $SP_{TP}$, through a plurality of transition phase transition points, $TP_{TP}$, to the transition phase ending point, $EP_{TP}$; wherein the transition phase path projected onto the x-y plane approximates a curve (more preferably wherein the transition phase path approximates a spiral easement). Most preferably, during the transition phase the location of the nozzle opening moves directly from the transition phase starting point, $SP_{TP}$, to the transition phase ending point, $EP_{TP}$; wherein the transition phase path projected onto the x-y plane is a straight line.

Figure 6A:
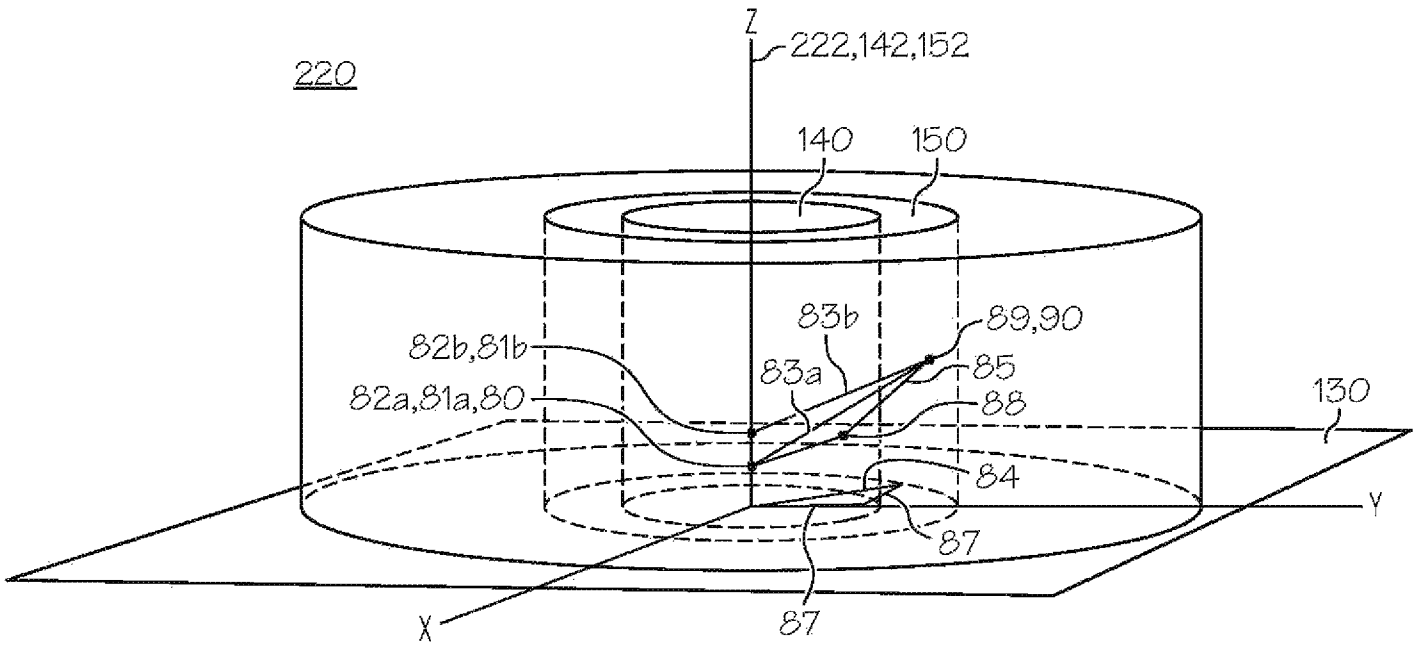
FIG. 6A is a depiction of a perspective top/side view of a mold cavity having a substantially circular cross section with a doughnut hole region and a doughnut region and depicting multiple exemplary initial phase and transition phase paths.
Figure 6B:
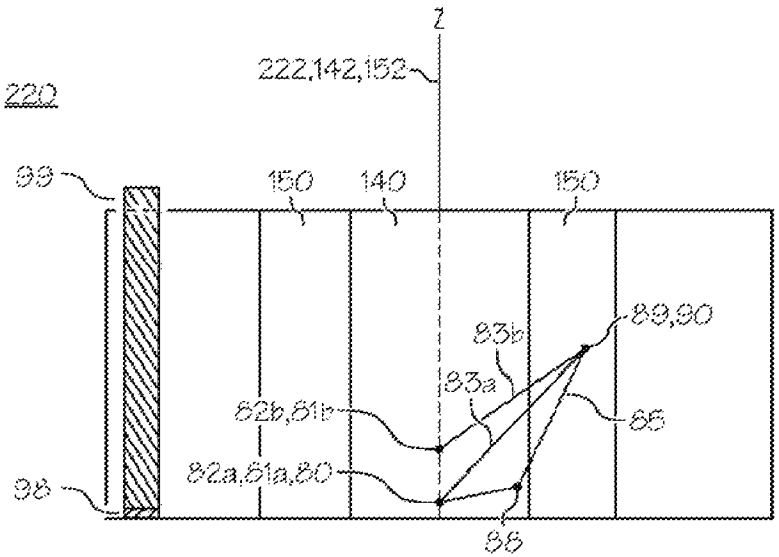
FIG. 6B is a depiction of a side elevation view of the mold cavity depicted in FIG. 6A.
Figure 6C:
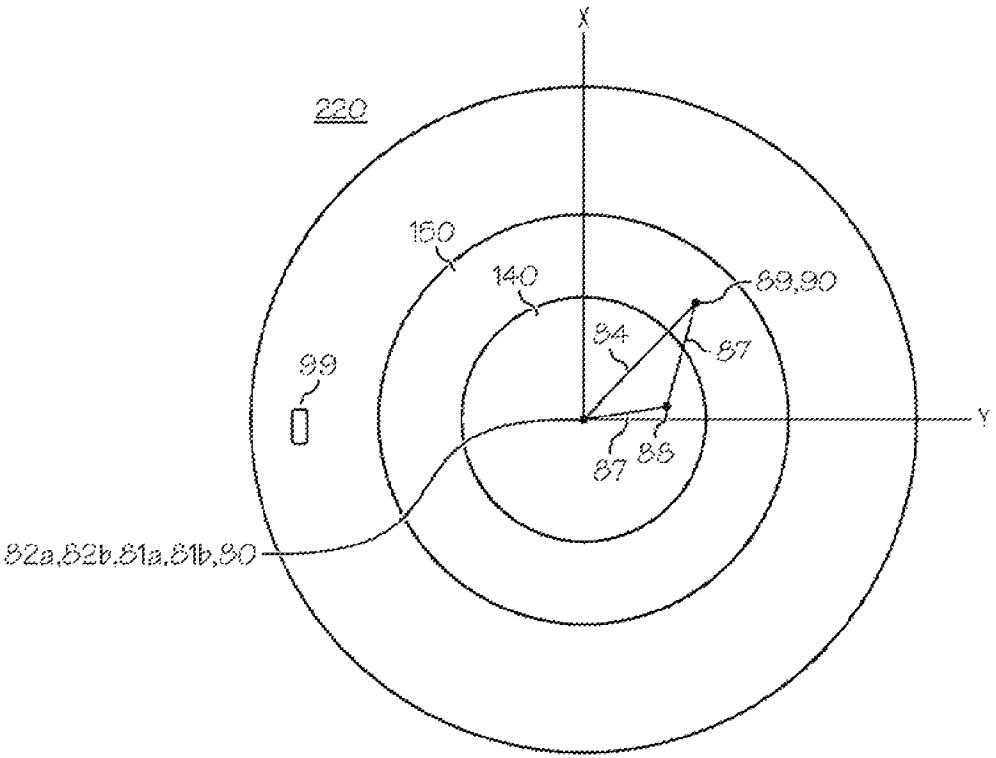
FIG. 6C is a depiction of a top plan view of the mold cavity depicted in FIG. 6A showing the projections onto the x-y plane of the initial phase and transition phase paths depicted in FIG. 6A.

FIGS. 6A-6C depict three different transition phase paths in a mold cavity (220) having a central axis, $C_{axis}$, (222); a right cylindrically shaped doughnut hole region (140) with an axis of symmetry, $DH_{axis}$, (142); and a toroid shaped doughnut region (150) with an axis of symmetry, $D_{axis}$, (152); wherein the mold cavity's central axis, $C_{axis}$, (222), the doughnut hole's axis of symmetry, $DH_{axis}$, (142) and the doughnut's axis of symmetry, $D_{axis}$, (152) each coincide with the z axis; and, wherein a window block (99) is bound with a window adhesive (98) within the mold cavity (220) outside both the doughnut hole region (140) and the doughnut region (150). A first transition phase path depicted in FIGS. 6A-6C begins at a transition phase starting point, $SP_{TP}$, (82*a*) within the doughnut hole region (140) of the mold cavity (220) and proceeds directly to a transition phase ending point, $EP_{TP}$, (89) within the doughnut region (150) of the mold cavity (220); wherein the transition phase path 83*a* projects as a single straight line (84) onto the x-y plane (130). A second transition phase path depicted in FIGS. 6A-6C begins at a transition phase starting point, $SP_{TP}$, (82*b*) within the doughnut hole region (140) of a mold cavity (220) and proceeds directly to a transition phase ending point, $EP_{TP}$, (89) within the doughnut region (150) of the mold cavity (220), wherein the transition phase path 83*b* projects as a single straight line (84) onto the x-y plane (130). A third transition phase path depicted in FIGS. 6A-6C begins at a transition phase starting point, $SP_{TP}$, (82*a*) within the doughnut hole region (140); transitions through a transition phase transition point, $TP_{TP}$, (88) within the doughnut hole region (140); and then proceeds to the transition phase ending point, $EP_{TP}$, (89) located within the doughnut region (150); wherein the transition phase path (85) projects a pair of connected lines (87) onto the x-y plane (130). Note that the transition phase end point, $EP_{TP}$, (89) corresponds with the remainder phase starting point, $SP_{RP}$, (90) (i.e., they are at the same location).

The location of the nozzle opening resides within the doughnut region during the remainder phase of the charging period (i.e., the location of the nozzle opening may pass through or reside in the doughnut hole region for some fraction of the remainder phase of the charging period). Preferably, the location of the nozzle opening resides within the doughnut region throughout the remainder phase of the charging period (i.e., for the duration of the remainder phase). Preferably, wherein the remainder phase is ≥10 seconds long. More preferably, the remainder phase is 10 to <(CP-0.2) seconds long; wherein CP is the charge period in seconds. Still more preferably, the remainder phase is 30 to <(CP-0.2) seconds long; wherein CP is the charge period in seconds. Most preferably, the remainder phase is 0.66*CP to <(CP-0.2) seconds long; wherein CP is the charge period in seconds. Preferably, the location of the nozzle opening moves relative to the mold cavity's central axis, $C_{axis}$, during the remainder phase at an average speed of 10 to 70 mm/sec (more preferably 15 to 35 mm/sec, most preferably 20 to 30 mm/sec). Preferably, the location of the nozzle opening can momentarily pause in its motion relative to the mold cavity's central axis, $C_{axis}$, at each remainder phase transition point, $TP_{RP}$ (i.e., the location of the nozzle opening can momentarily stop moving in the x and y dimensions). Preferably, the location of the nozzle opening moves at a constant speed relative to the mold cavity's central axis, $C_{axis}$, during the remainder phase from the remainder phase starting point, $SP_{RP}$, through each of the remainder phase transition points, $TP_{RP}$. Preferably, during the remainder phase the location of the nozzle opening moves from the remainder phase starting point, $SP_{RP}$, through a plurality of remainder phase transition points, $TP_{RP}$; wherein the remainder phase path projects a series of connected lines onto the x-y plane. Preferably, the remainder phase transition points, $TP_{RP}$, are all located within the doughnut region of the mold cavity. Preferably, the series of connected lines projected onto the x-y plane by the remainder phase path approximates either a circle or a two dimensional spiral with a varying distance from the mold cavity's central axis, $C_{axis}$. Preferably, the series of connected lines projected onto the x-y plane by the remainder phase path approximates a two dimensional spiral, wherein successive remainder phase transition points, $TP_{RP}$, project onto the x-y plane at either an increasing or a decreasing distance from the mold cavity's central axis, $C_{axis}$. More preferably, the series of connected lines projected onto the x-y plane by the remainder phase path approximates a circle, wherein successive remainder phase transition points, $TP_{RP}$, project onto the x-y plane at an equal distance from the mold cavity's central axis, $C_{axis}$, and wherein the series of connected lines projected onto the x-y plane by the remainder phase path is a regular polygon (i.e., equilateral and equiangular). Preferably, wherein the regular polygon has ≥5 sides (more preferably ≥8 sides; most preferably ≥10 sides; preferably ≤100 sides; more preferably ≤50 sides; most preferably ≤20 sides). Most preferably, wherein the remainder phase path approximates a helix. That is, during the remainder phase the location of the nozzle opening continues moving along the mold cavity's central axis, $C_{axis}$, to maintain the desired elevation above the top surface of the curable material collecting in the mold cavity while the location of the nozzle opening simultaneously traces a path that projects a regular polygon onto the x-y plane (preferably, wherein the regular polygon has 5 to 100 sides; more preferably, 5 to 50 sides; still more preferably, 8 to 25 sides; most preferably, 8 to 15 sides).

Figure 7A:
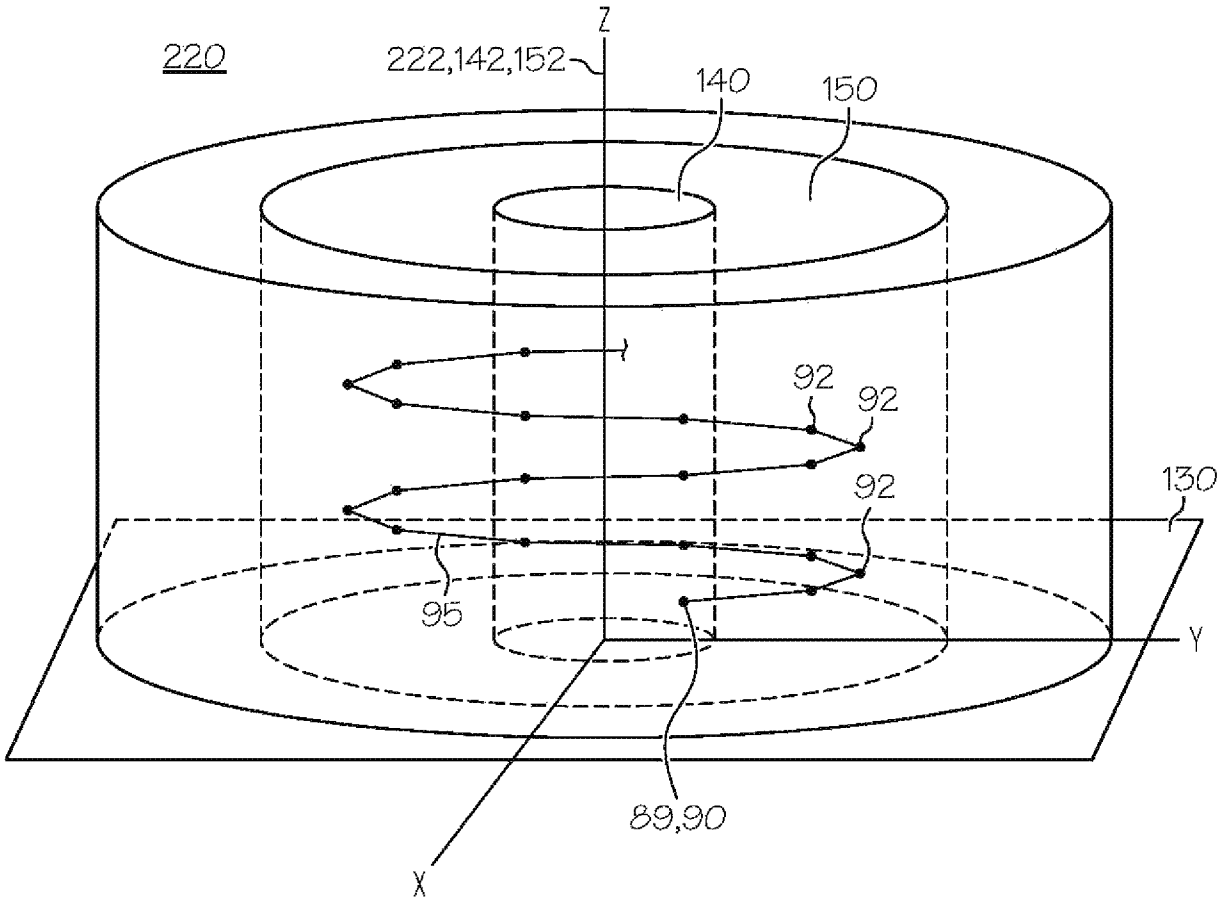
FIG. 7A is a depiction of a perspective top/side view of a mold cavity having a substantially circular cross section with a doughnut hole region and a doughnut region and depicting an exemplary remainder phase path.
Figure 7B:
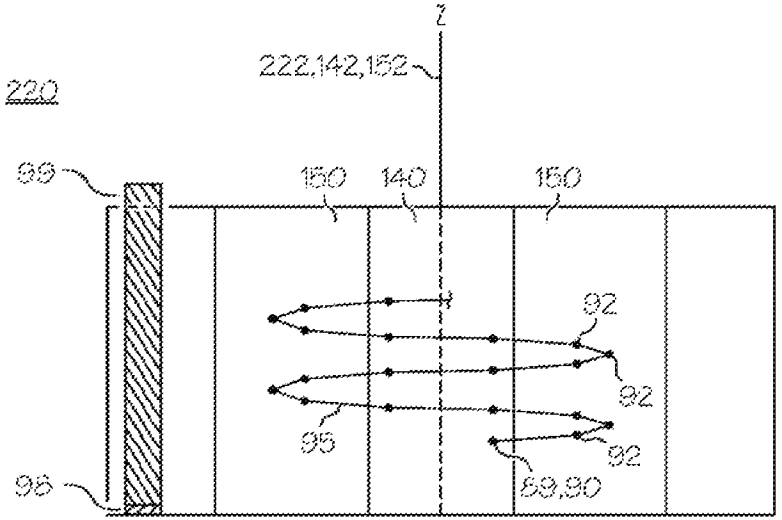
FIG. 7B is a depiction of a side elevation view of the mold cavity depicted in FIG. 7A.
Figure 7C:
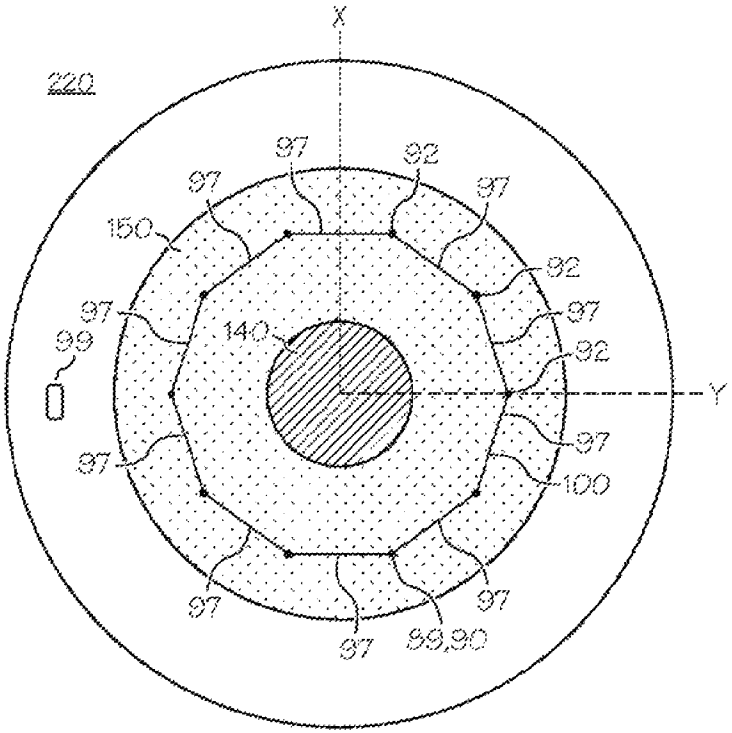
FIG. 7C is a depiction of a top plan view of the mold cavity depicted in FIG. 7A showing the projection onto the x-y plane of the remainder phase path depicted in FIG. 7A.

FIGS. 7A-7C depict a portion of a preferred remainder phase path (95) that approximates a helix within the mold cavity (220) having a central axis, $C_{axis}$, (222); a right cylindrically shaped doughnut hole region (140) with an axis of symmetry, $DH_{axis}$, (142); and a toroid shaped doughnut region (150) with an axis of symmetry, $D_{axis}$, (152); wherein the mold cavity's central axis, $C_{axis}$, (222), the doughnut hole's axis of symmetry, $DH_{axis}$, (142) and the doughnut's axis of symmetry, $D_{axis}$, (152) each coincide with the z axis; and, wherein a window block (99) is bound with a window adhesive (98) within the mold cavity (220) outside both the doughnut hole region (140) and the doughnut region (150). The remainder phase path (95) begins at a remainder phase starting point, $SP_{RP}$, (90) within the doughnut region (150) of the mold cavity (220) and proceeds through a plurality of remainder phase transition points, $TP_{RP}$, (92) within the doughnut region (150) of the mold cavity (220); wherein all the remainder phase transition points, $TP_{RP}$, are at an equal distance from the mold cavity's central axis, $C_{axis}$, (222); and, wherein the remainder phase path 95 projects onto the x-y plane (130) as ten equal length lines (97) forming a regular decahedron (100). Note that the remainder transition starting point, $SP_{RP}$, (90) corresponds with the transition phase ending point, $EP_{TP}$, (89) (i.e., they are at the same location).

The curable material comprises a liquid prepolymer. Preferably, the curable material comprises a liquid prepolymer and a plurality of microelements, wherein the plurality of microelements are uniformly dispersed in the liquid prepolymer.

The liquid prepolymer preferably polymerizes (i.e., cures) to form a material selected from poly(urethane), polysulfone, polyether sulfone, nylon, polyether, polyester, polystyrene, acrylic polymer, polyurea, polyamide, polyvinyl chloride, polyvinyl fluoride, polyethylene, polypropylene, polybutadiene, polyethylene imine, polyacrylonitrile, polyethylene oxide, polyolefin, poly(alkyl)acrylate, poly(alkyl)methacrylate, polyamide, polyether imide, polyketone, epoxy, silicone, polymer formed from ethylene propylene diene monomer, protein, polysaccharide, polyacetate and a combination of at least two of the foregoing. Preferably, the liquid prepolymer polymerizes to form a material comprising a poly(urethane). More preferably, the liquid prepolymer polymerizes to form a material comprising a polyurethane. Most preferably, the liquid prepolymer polymerizes (cures) to form a polyurethane.

Preferably, the liquid prepolymer comprises a polyisocyanate-containing material. More preferably, the liquid prepolymer comprises the reaction product of a polyisocyanate (e.g., diisocyanate) and a hydroxyl-containing material.

Preferably, the polyisocyanate is selected from methylene bis 4,4'-cyclohexyl-isocyanate; cyclohexyl diisocyanate; isophorone diisocyanate; hexamethylene diisocyanate; propylene-1,2-diisocyanate; tetramethylene-1,4-diisocyanate; 1,6-hexamethylene-diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of hexamethylene diisocyanate; triisocyanate of 2,4,4-trimethyl-1,6-hexane diisocyanate; urtdione of hexamethylene diisocyanate; ethylene diisocyanate; 2,2,4-trimethylhexamethylene diisocyanate; 2,4,4-tri-methylhexamethylene diisocyanate; dicyclohexylmethane diisocyanate; and combinations thereof. Most preferably, the polyisocyanate is aliphatic and has less than 14 percent unreacted isocyanate groups.

Preferably, the hydroxyl-containing material used with the present invention is a polyol. Exemplary polyols include, for example, polyether polyols, hydroxy-terminated polybutadiene (including partially and fully hydrogenated derivatives), polyester polyols, polycaprolactone polyols, polycarbonate polyols, and mixtures thereof.

Preferred polyols include polyether polyols. Examples of polyether polyols include polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone; diethylene glycol initiated polycaprolactone; trimethylol propane initiated polycaprolactone; neopentyl glycol initiated polycaprolactone; 1,4-butanediol-initiated polycaprolactone; PTMEG-initiated polycaprolactone; and mixtures thereof. The hydrocarbon chain can have saturated or unsaturated bonds, or substituted or unsubstituted aromatic and cyclic groups. Suitable polycarbonates include, but are not limited to, polyphthalate carbonate and poly(hexamethylene carbonate) glycol.

Preferably, the plurality of microelements are selected from entrapped gas bubbles, hollow core polymeric materials (i.e., microspheres), liquid filled hollow core polymeric materials, water soluble materials (e.g., cyclodextrin) and an insoluble phase material (e.g., mineral oil). Preferably, the plurality of microelements are microspheres, such as, polyvinyl alcohols, pectin, polyvinyl pyrrolidone, hydroxyethylcellulose, methylcellulose, hydropropylmethylcellulose, carboxymethylcellulose, hydroxypropylcellulose, polyacrylic acids, polyacrylamides, polyethylene glycols, polyhydroxyetheracrylites, starches, maleic acid copolymers, polyethylene oxide, polyurethanes, cyclodextrin and combinations thereof (e.g., Expancel™ from Akzo Nobel of Sundsvall, Sweden). The microspheres can be chemically modified to change the solubility, swelling and other properties by branching, blocking, and crosslinking, for example. Preferably, the microspheres have a mean diameter that is less than 150 μm, and more preferably a mean diameter of less than 50 μm. Most Preferably, the microspheres 48 have a mean diameter that is less than 15 μm. Note, the mean diameter of the microspheres can be varied and different sizes or mixtures of different microspheres 48 can be used. A most preferred material for the microspheres is a copolymer of acrylonitrile and vinylidene chloride (e.g., Expancel® available from Akzo Nobel).

The liquid prepolymer optionally further comprises a curing agent. Preferred curing agents include diamines. Suitable polydiamines include both primary and secondary amines. Preferred polydiamines include, but are not limited to, diethyl toluene diamine ("DETDA"); 3,5-dimethylthio-2,4-toluenediamine and isomers thereof; 3,5-diethyltoluene-2,4-diamine and isomers thereof (e.g., 3,5-diethyltoluene-2,6-diamine); 4,4'-bis-(sec-butylamino)-diphenylmethane; 1,4-bis-(sec-butylamino)-benzene; 4,4'-methylene-bis-(2-chloroaniline); 4,4'-methylene-bis-(3-chloro-2,6-diethylaniline) ("MCDEA"); polytetramethyleneoxide-di-p-aminobenzoate; N,N'-dialkyldiamino diphenyl methane; p,p'-methylene dianiline ("MDA"); m-phenylenediamine ("MPDA"); methylene-bis 2-chloroaniline ("MBOCA"); 4,4'-methylene-bis-(2-chloroaniline) ("MOCA"); 4,4'-methylene-bis-(2,6-diethylaniline) ("MDEA"); 4,4'-methylene-bis-(2,3-dichloroaniline) ("MDCA"); 4,4'-diamino-3,3'-diethyl-5,5'-dimethyl diphenylmethane, 2,2',3,3'-tetrachloro diamino diphenylmethane; trimethylene glycol di-p-aminobenzoate; and mixtures thereof. Preferably, the diamine curing agent is selected from 3,5-dimethylthio-2,4-toluenediamine and isomers thereof.

Curing agents can also include diols, triols, tetraols and hydroxy-terminated curatives. Suitable diols, triols, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(beta-hydroxyethyl)ether; hydroquinone-di-(beta-hydroxyethyl)ether; and mixtures thereof. Preferred hydroxy-terminated curatives include 1,3-bis(2-hydroxyethoxy) benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol; and mixtures thereof. The hydroxy-terminated and diamine curatives can include one or more saturated, unsaturated, aromatic, and cyclic groups. Additionally, the hydroxy-terminated and diamine curatives can include one or more halogen groups.

Preferably, cakes produced using the method of the present invention contain fewer density defects compared to cakes produced using the same process except that throughout the charging period, CP, the location of the nozzle opening moves in only one dimension along the mold cavity's central axis, $C_{axis}$ (i.e., to maintain the location of the nozzle opening at a set elevation above the top surface of the curable material as it collects in the mold cavity). More preferably, wherein cakes produced using the method of the present invention provide at least 50% more (more preferably at least 75% more; most preferably at least 100% more) density defect free polishing layers per cake. Still more preferably, wherein the mold cavity has a substantially circular cross section having an average radius, $r_C$; wherein $r_C$ is 40 to 60 cm; and wherein the cake produced using the method of the present invention provides a 2 fold increase (more preferably a 3 fold increase) in the number of density defect free polishing layers compared to the number of density defect free polishing layers provided by a cake produced using the same process except that throughout the charging period, CP, the location of the nozzle opening moves in only one dimension along the mold cavity's central axis, $C_{axis}$.

In the method of the present invention, the cured cakes are skived into a plurality of polishing layers of desired thickness using a skiver blade having a cutting edge. Preferably, a stropping compound is applied to the cutting edge of the skiver blade, and a strop is used to hone the cutting edge before skiving the cake into the plurality of polishing layers, wherein each polishing layer has an integral window. Stropping compound used in the method of the present invention preferably comprises an aluminum oxide abrasive dispersed in a fatty acid. More preferably, the stropping compound used in the method of the present invention comprises 70 to 82 wt % aluminum oxide abrasive dispersed in 18 to 35 wt % fatty acid. The strop used in the method of the present invention is preferably a leather strop. Most preferably, the strop used in the method of the present invention is a leather strop designed for use with a rotary tool (e.g., Dremel® rotary tool).

Optionally, in the method of the present invention, the cured cake is heated to facilitate the skiving operation. Preferably, the cured cake is heated using infrared heating lamps during the skiving operation in which the cured cake is skived into a plurality of polishing layers, wherein each polishing layer has an integral window.

Preferably, polishing layers produced using the method of the present invention exhibit a polishing surface with decreased surface roughness compared to polishing layers produced using the same process except that throughout the charging period, CP, the location of the nozzle opening moves in only one dimension along the mold cavity's central axis, $C_{axis}$ (i.e., to maintain the location of the nozzle opening at a set elevation above the top surface of the curable material as it collects in the mold cavity) and the skiver blade is stone sharpened rather than stropped before cake skiving. More preferably, wherein polishing layers produced using the method of the present invention exhibit a polishing surface with at least a 10% (more preferably at least 20%; most preferably at least 25%) reduction in surface roughness.

We claim:

1. A method of forming a polishing layer for a chemical mechanical polishing pad, comprising:

providing a mold, having a mold base and a surrounding wall attached to the mold base;

providing a liner with a top surface, a bottom surface and an average thickness of 2 to 10 cm;

providing a liner adhesive;

providing a window block;

providing a window adhesive;

providing a curable material comprising a liquid prepolymer;

providing a nozzle, having a nozzle opening;

providing a skiver blade with a cutting edge;

providing a strop;

providing a stropping compound;

bonding the bottom surface of the liner to the mold base using the liner adhesive, wherein the top surface of the liner and the surrounding wall define a mold cavity;

bonding the window block to the top surface of the liner using the window adhesive;

charging the curable material through the nozzle opening to the mold cavity during a charging period, CP;

allowing the curable material in the mold cavity to cure into a cake;

separating the surrounding wall from the mold base and the cake;

applying the stropping compound to the cutting edge;

stropping the skiver blade with the strop; and, slicing the cake into multiple chemical mechanical polishing layers, wherein each polishing layer has an integral window.

2. The method of claim 1, further comprising providing a heat source; and, exposing the cake to the heating source before slicing the cake into multiple chemical mechanical polishing layers.

3. The method of claim 1, wherein the curable material further comprises a plurality of microelements;

wherein the top surface of the liner defines a horizontal internal boundary of the mold cavity, wherein the internal horizontal boundary of the mold is oriented along an x-y plane, wherein the mold cavity has a central axis, $C_{axis}$, that is perpendicular to the x-y plane, and wherein the mold cavity has a doughnut hole region and a doughnut region;

wherein the charging period, CP, is broken down into three separate phases identified as an initial phase, a transition phase and a remainder phase; wherein the nozzle opening has a location and wherein the location of the nozzle opening moves relative to mold base along the mold cavity's central axis, $C_{axis}$, during the charging period, CP, to maintain the location of the nozzle opening above a top surface of the curable material in the mold cavity as the curable material collects in the mold cavity;

wherein the location of the nozzle opening resides within the doughnut hole region throughout the initial phase;

wherein the location of the nozzle opening transitions from residing within the doughnut hole region to residing within the doughnut region during the transition phase; and, wherein the location of the nozzle opening resides within the doughnut region during the remainder phase.

4. The method of claim 3, wherein the movement of the location of the nozzle opening momentarily pauses in its motion relative to the mold cavity's central axis, $C_{axis}$, during the remainder phase.

5. The method of claim 3, wherein the curable material is charged to the mold cavity at an essentially constant rate over the charging period, CP, with an average charging rate, $CR_{avg}$, of 0.015 to 2 kg/sec.

6. The method of claim 3, wherein the mold cavity is symmetric about the mold cavity's central axis, $C_{axis}$.

7. The method of claim 6, wherein the mold cavity approximates a right cylindrically shaped region having a substantially circular cross section, $C_{x\text{-}sect}$; wherein the mold cavity has an axis of symmetry, $C_{x\text{-}sym}$, which coincides with the mold cavity's central axis, $C_{axis}$; wherein the right cylindrically shaped region has a cross sectional area, $C_{x\text{-}area}$, defined as follows:

$$C_{x\text{-}area}=\pi r_C^2,$$

wherein $r_C$ is the average radius of the mold cavity's cross sectional area, $C_{x\text{-}area}$, projected onto the x-y plane; wherein the doughnut hole region is a right cylindrically shaped region within the mold cavity that projects a circular cross section, $DH_{x\text{-}sect}$, onto the x-y plane and has an axis of symmetry, $DH_{axis}$; wherein the doughnut hole has a cross sectional area, $DH_{x\text{-}area}$, defined as follows:

$$DH_{x\text{-}area}=\pi r_{DH}^2,$$

wherein $r_{DH}$ is a radius of the doughnut hole region's circular cross section, $DH_{x\text{-}sect}$; wherein the doughnut region is a toroid shaped region within the mold cavity that projects an annular cross section, $D_{x\text{-}sect}$, onto the x-y plane and that has a doughnut region axis of symmetry, $D_{axis}$; wherein the annular cross section, $C_{x\text{-}sect}$, has a cross sectional area, $D_{x\text{-}area}$, defined as follows:

$$D_{x\text{-}area}=\pi R_D^2-\pi r_D^2$$

wherein $R_D$ is a larger radius of the doughnut region's annular cross section, $D_{x\text{-}sect}$; wherein $r_D$ is a smaller radius of the doughnut region's annular cross section, $D_{x\text{-}sect}$; wherein $r_D \geq r_{DH}$; wherein $R_D > r_D$; wherein $R_D < r_C$.; wherein each of the $C_{x\text{-}sym}$, the $DH_{axis}$ and the $D_{axis}$ are perpendicular to the x-y plane.

8. The method of claim 7, wherein $R_D \leq (K^* r_C)$, wherein K is 0.01 to 0.2.

9. The method of claim 7, wherein $r_D = r_{DH}$; wherein $r_D$ is 5 to 25 mm; wherein $R_D$ is 20 to 100 mm; wherein $r_C$ is 20 to 100 cm.

10. The method of claim 9, wherein the cake produced using the method of the present invention contains fewer density defects compared to another cake produced using the same process except that throughout the charging period, CP, the location of the nozzle opening moves in only one dimension along the mold cavity's central axis, $C_{axis}$.

* * * * *